United States Patent [19]

Reeder

[11] 3,980,382

[45] Sept. 14, 1976

[54] MATCHED IMPEDANCE COAXIAL CABLE TO PRINTED CIRCUIT BOARD TERMINATOR

[75] Inventor: Larry R. Reeder, San Jose, Calif.

[73] Assignee: Raychem Corporation, Menlo Park, Calif.

[22] Filed: June 3, 1974

[21] Appl. No.: 475,753

[52] U.S. Cl. ..... 339/177 R; 339/17 C

[51] Int. Cl.[2] ..... H01R 17/18

[58] Field of Search ..... 339/17 R, 17 C, 177 R, 339/177 E, DIG. 1

[56] References Cited

UNITED STATES PATENTS

| | | | |
|---|---|---|---|
| 3,141,718 | 7/1964 | Schott | 339/177 E |
| 3,141,924 | 7/1964 | Forney | 339/276 |
| 3,179,912 | 4/1965 | Huber | 339/17 R |
| 3,243,211 | 3/1966 | Wetmore | 339/DIG. 1 |
| 3,742,425 | 6/1973 | Peltola | 339/177 R |

*Primary Examiner*—Roy Lake
*Assistant Examiner*—Mark S. Bicks
*Attorney, Agent, or Firm*—Lyon & Lyon

[57] ABSTRACT

A device for terminating a coaxial cable to a printed circuit board with a minimum of impedance mismatch is disclosed. The terminator includes a conductive body having a plurality of legs which are designed to pass through holes in the printed circuit board to mechanically attach a coxial cable to the board and electrically terminate the shield of the coaxial cable to an appropriate circuit on the board. The coaxial cable is mechanically connected to the conductive body by a heat shrinkable sleeve, the shielding of the cable being first exposed so that it can make an electrical connection with the conductive body. The center conductor of the cable is bent at right angles with the axis of the cable such that it too will pass through a hole in the printed circuit board and be electrically connected to an appropriate circuit on the board. This bend is made within the confines of a pair of tabs formed on the conductive body which hold the dielectric surrounding the center conductor and in effect form a continuation of the shield so that the impedance of the termination is kept relatively constant.

24 Claims, 6 Drawing Figures

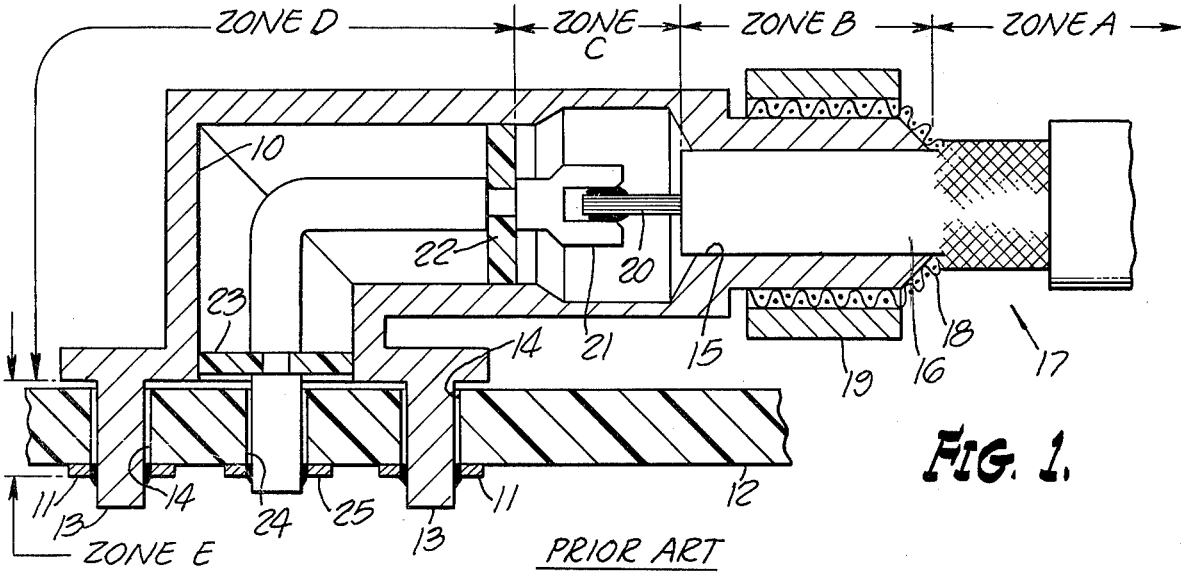
FIG. 1.
FIG. 2.
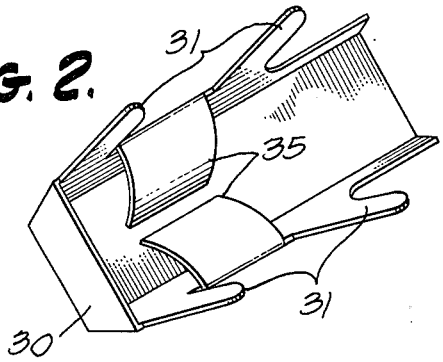
FIG. 4.
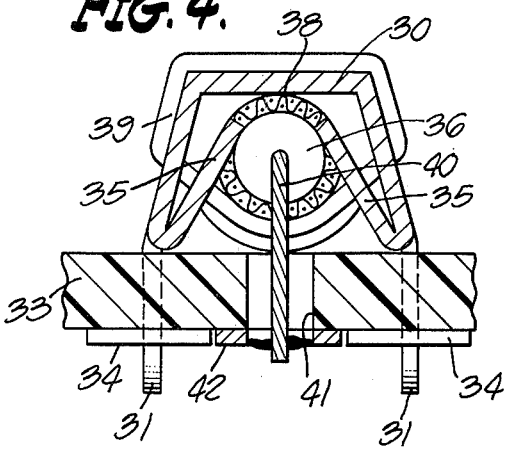
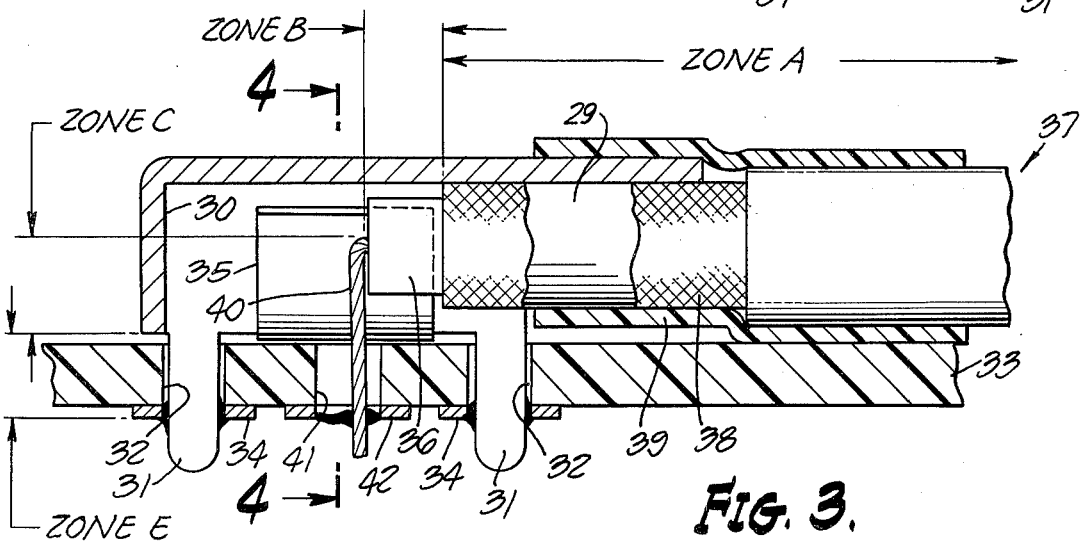
FIG. 3.

MATCHED IMPEDANCE COAXIAL CABLE TO PRINTED CIRCUIT BOARD TERMINATOR

BACKGROUND OF THE INVENTION

There are many instances where it is necessary to terminate a coaxial cable to a printed circuit board. Two of the important factors to be taken into account in making such a termination are the ease and reliability with which the connection is made and the impedance match that can be obtained. These two factors have often been found to compete with each other; moreover, presently available terminating devices are generally usable only with a cable of a particular size, and having a particular characteristic impedance, thus requiring that a large inventory of terminators be maintained. A more detailed discussion of these matters will be set forth hereinafter in connection with a description of a typical prior art terminator as shown in FIG. 1.

SUMMARY OF THE INVENTION

The present invention provides a terminator which is relatively easy to install and which reduces impedance mismatch to a minimum. The terminator of the present invention is also capable of being used with a plurality of different diameter coaxial cables so that it is more versatile than terminators here before used. These advantages are realized by directly connecting the center conductor of the cable to the printed circuit board without need for any intermediate connector device, and by providing the conductive body which electrically connects the shielding of the cable to the board with capacitive tabs which contact the dielectric of the center conductor in the area where the center conductor protrudes therefrom and is connected to the board. These capacitive tabs serve as a continuation of the shield and thus greatly reduce the length of the zone where an impedance transition can take place. Moreover, these tabs are such that the device is adaptable to receiving different sizes of cable without in any way affecting their performance.

It is therefore an object of the present invention to provide an improved device for terminating a coaxial cable to a printed circuit board.

It is another object of the present invention to provide such a device which is capable of accommodating a variety of sizes of coaxial cable.

It is still another object of the present invention to provide such a device which accommodates cables of any desired characteristic impedance.

It is a further object of the present invention to provide a terminating device which can be used to terminate more than one cable at once and which is useful in high density mounting and packaging schemes.

DESCRIPTION OF THE DRAWINGS

FIG. 1 is a side elevation, shown in cross section, of a prior art terminator;

FIG. 2 is a perspective view, taken from the bottom, of the terminator of the present invention;

FIG. 3 is a side elevation, taken in cross section, of the terminator of the present invention in its installed condition;

FIG. 4 is a cross-sectional view taken along lines 4—4 of FIG. 3;

DESCRIPTION OF THE INVENTION

Figure 6:
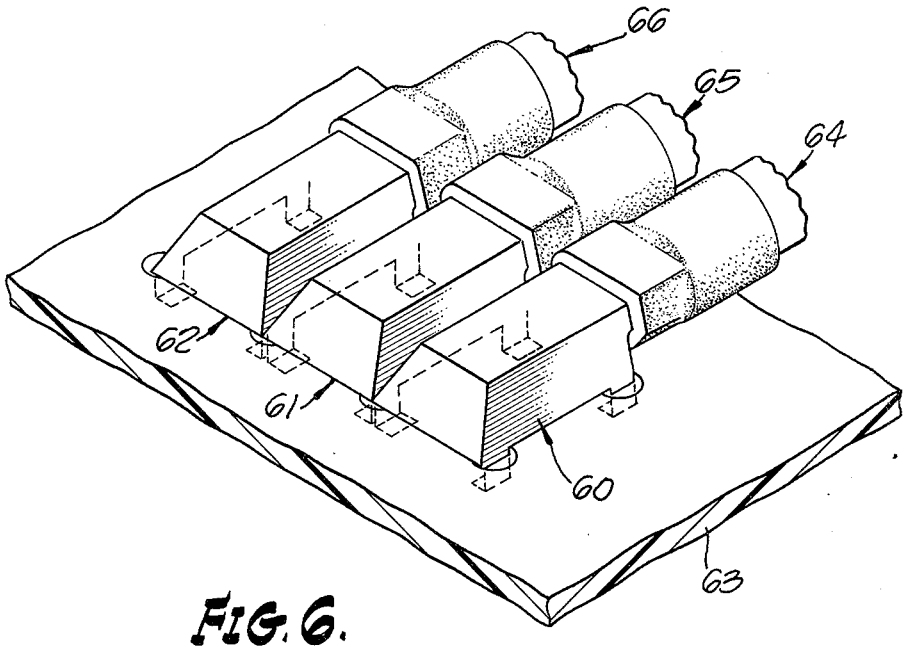
FIG. 6 is a perspective view illustrating the manner in which a plurality of the terminator devices of the present invention can be used together.

It is believed that an appreciation of the structure and the advantages of the present invention can best be had upon understanding of the prior art, a typical example which is shown in FIG. 1. The terminator of FIG. 1 includes a conductive body or housing 10 which is mechanically and electrically connected to appropriate printed circuit pads 11 on printed circuit board 12 by means of legs 13 which extend through holes 14 in the printed circuit board 12.

The conductive body 10 is provided at one end with an opening 15 for receiving the dielectric 16 of a coaxial cable 17. The outer conductor or shield 18 of the cable 17 is mechanically and electrically connected to the conductive body 10 by a crimping ferrule 19. The center conductor 20 of the cable 17 is connected, for example, by solder, to one end of a central conductive member 21 positioned within the conductive body 10 but electrically isolated therefrom by insulating spacers 22 and 23. The opposite end of the conductive member 21 extends through a hole 24 in a printed circuit board 12 and is soldered to a circuit pad 25.

The center conductor 20 of the cable 17 normally carries the more critical portion of the circuit, the outer conductor 18 often acting only as a shield. At the same time, the center conductors are more fragile and more difficult to terminate and the terminator must normally be supplied as an unassembled pile of loose parts. These parts are partially assembled by the operator, the center conductor 20 is connected to the inner conductive member 21, and the balance of the parts are then assembled around this connection, completely hiding it from view. Of the two connections in the center conductor chain, the more fragile, more complex one is thus completely obscured from visual inspection.

The impedance characteristics of the prior art terminator are also indicated on FIG. 1. The geometry of the coaxial cable 17, and hence its characteristic impedance, is undisturbed through zone A. The insertion of the end of the conductive body 10 between the cable shield 18 and the cable dielectric 16 in zone B will severely disturb the characteristic impedance unless the diameter of the opening 15 in the body 10 fits tightly around and contacts the cable dielectric 16. If a smaller diameter cable of the same impedance were inserted in the conductive body 10, there would be an air gap between the cable dielectric and the inner wall of the conductive body. This would drastically reduce the capacitance and in turn raise the impedance in zone B causing a mismatch.

In zone C, the cable dielectric 16 must be removed from the center conductor 20 in order to permit the latter's connection to the central conductive member 21. Additionally, the central conductive member 21 must be of a diameter larger than that of the cable conductor 20 in order to provide for conductor insertion. Both dielectric removal and change of inner diameter will affect the characteristic impedance. These effects can be minimized by suitable adjustments but these adjustments must be aimed at achieving a single desired fixed characteristic impedance. The design parameters of zone D can also be adjusted to achieve the desired impedance but these adjustments must be also aimed at the single fixed impedance desired. The impedance of zone E is basically a function of the printed circuit board design and is not important here.

A terminator less complex and more flexible than the prior art device of FIG. 1 is shown in FIGS. 2, 3 and 4. As can be seen from these figures, the terminator of the present invention comprises a conductive body or housing 30 which is open at the bottom and at one end, and which is provided at its extremities with a plurality of depending legs 31 which extend through holes 32 in a printed circuit board 33 and can be soldered to printed circuit board pads 34. The conductive body 30 has as an integral part thereof a pair of conductive tabs 35 positioned between the forward and backward pairs of legs 31. These tabs 35 are bent inwardly and upwardly and are adapted to receive the dielectric 36 of a coaxial cable 37. Preferably, the material from which the conductive body 30, including the tabs 35, is fabricated is sufficiently ductile to permit its permanent displacement upon insertion of the dielectric 36 but retain sufficient springiness to be biased into engagement with the dielectric 36.

The outer conductor or shield 38 of the cable 37 is inserted into the conductive body 30 and connected thereto in any desired fashion, preferably by means of a soldered connection. This connection is incapsulated, and the jacketing of the cable 37 extended on to the conductive body 30, by a piece of heat shrinkable tubing 39. Preferably, the soldered connection and incapsulation is accomplished simultaneously by use of a connector in which a solder ring is positioned within a heat shrinkable tube such as the one disclosed in Wetmore U.S. Pat. No. 3,243,211, the disclosure of which is incorporated by reference herein. The coaxial cable 37 is positioned in the conductive body 30 such that the exposed center conductor 40 is bent sharply downward at the end of the exposed dielectric 36 and directly enters a hole 41 in the printed circuit board 33 so that it can be directly soldered to printed circuit pad 42 on the board 33. Thus, there is only a single connection in the center conductive path and that connection may be readily inspected visually.

The impedance characteristic of the terminator of the present invention is illustrated in FIG. 3. The cable geometry, and hence the impedance, remains undisturbed through zone A up to the point where the cable dielectric 36 is exposed. In zone B, the capacitance drops, and the impedance rises, because the cable shield 38 has been removed. The drop in capacitance is minimized, however, by the conductive tabs 35. Since these tabs 35 are merely extensions of the conductive body 30 which is electrically connected to the cable shield 38, they act as a continuum of that shield and tend to restore the cable to its original characteristic impedance regardless of what that impedance is. This is so even for dielectric of different diameters as the tabs 35 will deflect to accommodate these different diameter dielectrics while still remaining in contact with them. To some extent the dielectric can also deflect from its normal longitudinal axis. Thus, the impedance of zone B using a 120 ohm cable will approach 120 ohms, yet the impedance of zone B will approach 25 ohms if a 25 ohm cable is substituted. Accordingly, a single terminator may be used to terminate cables of different sizes and different characteristic impedances and still maintain a good impedance match.

In zone C, the bare center conductor 40 of the cable 37 is partially surrounded by the tabs 35. In this zone the tabs 35 are less effective in restoring the impedance since the dielectric medium is air and the lower end of the center conductor 40 is moving away from the tabs. However the length of zone C is relatively short, typically 0.40 inches or less for the popular RG type cables, and it has no appreciable effect at normal operating frequencies.

The terminator of the present invention thus provides for the direct connection of the cable center conductor to the printed circuit in a manner which permits inspection of the connection and therefore is less complex and more reliable than previously proposed terminators. Moreover, the present terminator has no characteristic impedance of its own that must be matched to both cable and printed circuit board so that it can be used to make a connection between a wide range of cables and boards having the same characteristic impedance. In addition, the terminator accommodates a broad range of cable sizes with no substantial degradation of signal. The terminator of the present invention may be used with equal facility on printed circuit boards of various constructions, for example, single sided, double sided, double sided plated through holes and multi-layer, plated through holes.

Figure 5:
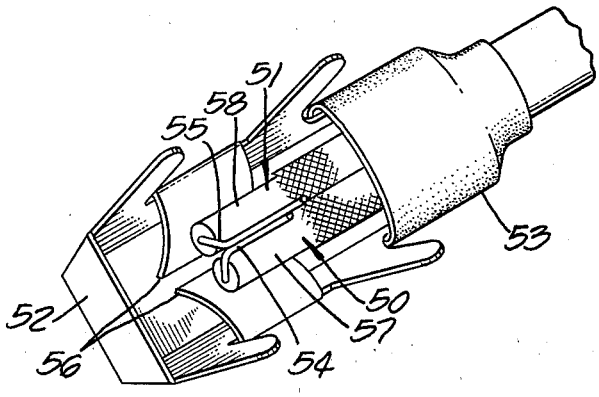
FIG. 5 is a perspective view, taken from the bottom, showing the manner in which a terminating device of the present invention can be used to terminate more than one cable simultaneously.

The terminator of the present invention can also be used to terminate more than one cable at once. As can be seen in FIG. 5, two cables 50 and 51 are received in the conductive body 52. As was the case in FIG. 3 (see solder connection 29), the shields of the cables 50 and 51 are soldered or otherwise connected to the conductive body 52 and are maintained in place by a heat shrinkable member 53. The dielectrics 57 and 58 of the cables 50 and 51 are positioned between conductive tabs 56 while the center conductors 54 and 55 can be passed through a single hole in a printed circuit board and terminated to the same pad thereon.

The terminators of the present invention are also highly adaptable for high density mounting and packaging schemes, particularly where all cable shields must be commoned together while the signal carrying center conductors are isolated. As shown in FIG. 6, a plurality of terminators 60, 61 and 62 are mounted on a printed circuit board 63. The adjoining leg of the terminators are passed through the same hole in the printed circuit board 63 and terminated to the same printed circuit tab. This has the effect of commonly connecting the shields of the three cables 64, 65 and 66 which are terminated by the devices 60, 61 and 62.

It should be understood that the particular physical configuration of the conductive body of the terminating device and the other mechanical details illustrated are not critical to the obtaining of the advantages of the present invention and that other equivalent structures can be used. The foregoing description is thus to be considered as illustrative and not limiting, the scope of the invention being defined by the following claims.

I claim:

1. A terminating device for a coaxial cable having a shield, a center conductor and a dielectric separating said shield and center conductor comprising:

a conductive body having sidewalls and a plurality of legs adapted for connection to selected areas of a circuit;

tab means adapted to receive and physically contact said dielectric and position said center conductor over a further selected area of a circuit, said tab means being electrically and mechanically connected to said conductive body said tab means projecting into the space defined by said conductor body at an acute angle to said sidewalls; and means adapted to electrically connect said shield to said conductive body.

2. The device of claim 1 wherein said tab means are integral with said conductive body and are adapted to position said center conductor for a direct connection to said further selected area of a circuit.

3. The device of claim 2 wherein said conductive body has a pair of lateral edges formed by said sidewalls, said tab means being positioned on said lateral edges.

4. The device of claim 3 wherein said tab means are sufficiently flexible to permit them to accommodate dielectrics of different diameters.

5. The device of claim 4 wherein said conductive body is provided with two pairs of legs and wherein said tab means are positioned between said pairs of legs.

6. The device of claim 5 wherein said legs are located at the extremities of said body.

7. A terminating substantially impedance matched device for a coaxial cable having a shield, a center conductor and a dielectric separating said shield and center conductor comprising;

a conductive housing having sidewalls, at least one open end and being open at the bottom, said conductive housing being adapted to be connected to said shield of said cable;

a plurality of integral legs depending from said housing on either side of said open side; and clamping means located within said housing and electrically and mechanically coupled thereto;

said clamping means being adapted to receive the dielectric of said cable and comprising tab means projecting into the space defined by said conductive body at an acute angle to said sidewalls.

8. The device of claim 7 wherein said clamping means comprise integral tabs formed on the sidewalls of said conductive housing adjacent the open bottom thereof.

9. A device for terminating a coaxial cable having a shield, a center conductor and a dielectric separating the shield and the center conductor to a printed circuit board having a plurality of holes and at least one circuit formed thereon comprising:

a conductive housing having sidewalls at least one open end and being open at the bottom, said open end receiving said cable;

means for electrically connecting the shield of said cable to the inner surface of said housing adjacent the open end thereof;

a plurality of integral legs depending from said housing on either side of said open side, said legs being inserted into selected holes in said printed circuit board to connect said conductive housing to selected parts of the circuit printed thereon; and a pair of integral tabs formed on said housing between the legs of each pair of legs, said tabs projecting into said housing for contacting said dielectric at an acute angle to said sidewalls.

10. A terminating device for terminating a coaxial cable to a printed circuit board having a plurality of holes therein and at least one circuit thereon, said coaxial cable having a shield, a center conductor and a dielectric separating said center conductor and said shield, said center conductor extending beyond said dielectric and at substantially a right angle thereto comprising:

a conductive housing having sidewalls, at least one open end and being open at the bottom, said open end adapted for receiving said cable;

means for electrically connecting the shield of said cable to the inner surface of said housing adjacent the open end thereof;

a plurality of integral legs depending from said housing on either side of said open side, said legs being inserted into selected holes in said printed circuit board to connect said conductive housing to selected parts of the circuit printed thereon; and a pair of integral tabs formed on said housing between the legs of each pair of legs, said tabs projecting into said housing at an acute angle to said sidewalls for positioning said dielectric such that said center conductor passes through a further selected hole in said printed circuit board.

11. The device of claim 10 wherein said tabs are sufficiently flexible to permit them to accommodate dielectrics of different diameters.

12. A terminating device for terminating a plurality of coaxial cables to a printed circuit board having a plurality of holes therein and at least one circuit thereon each of said coaxial cables having a shield, a center conductor and a dielectric separating said center conductor and said shield comprising:

a conductive housing having sidewalls, at least one open end and being open at the bottom, said open end adapted for receiving said cables;

means for electrically connecting the shield of each of said cables to the inner surface of said housing adjacent the open end thereof;

a plurality of integral legs depending from said housing on either side of said open side, said legs being inserted into selected holes in said printed circuit board to connect said conductive housing to selected parts of the circuit printed thereon; and a pair of integral tabs formed on said housing between the legs of each pair of legs, said tabs projecting into said housing at an acute angle to said sidewalls and contacting said dielectrics.

13. A terminating device for terminating a plurality of coaxial cable to a printed circuit board having a plurality of holes therein and at least one circuit thereon, each of said coaxial cables having a shield, a center conductor and a dielectric separating said center conductor and said shield, said center conductors extending beyond said dielectrics and at substantially a right angle thereto comprising:

a conductive housing having sidewalls, at least one open end and being open at the bottom, said open end adapted for receiving said cable;

means for electrically connecting the shield of each of said cables to the inner surface of said housing adjacent the open end thereof;

a plurality of integral legs depending from said housing on either side of said open side, said legs being inserted into selected holes in said printed circuit board to connect said conductive housing to selected parts of the circuit printed thereon; and a pair of integral tabs formed on said housing between the legs of each pair of legs, said tabs projecting into said housing at an acute angle to said sidewalls and positioning said dielectrics such that said center conductors pass through further selected holes in said printed circuit board.

14. An electrical connection comprising:

a coaxial cable having a shield, a center conductor and a dielectric separating said center conductor from said shield;

a conductive housing having sidewalls, at least one open end and being open at the bottom, said open end receiving said cable;

means for electrically connecting the shield of said cable to the inner surface of said housing adjacent the open end thereof;

a plurality of integral legs depending from said housing on either side of said open side; and a pair of integral tabs formed on said housing between the legs of each pair of legs, said tabs projecting into said housing at an acute angle to said sidewalls and contacting said dielectric.

15. The connection of claim 14 wherein a heat shrinkable sleeve is shrunk over a portion of said cable and a portion of said housing adjacent the open end thereof.

16. The connection of claim 14 wherein said tabs are sufficiently flexible to permit them to accommodate dielectrics of different diameters.

17. The connection of claim 14 wherein a plurality of said coaxial cables are received by said housing, the shield of each such cable being connected to said housing and the dielectric of each such cable being positioned between said tabs.

18. The connection of claim 14 wherein said means for electrically connecting said shield to said housing is further defined as solder means.

19. An electrical connection comprising:

a coaxial cable having a shield, a center conductor and a dielectric separating said center conductor from said shield;

a printed circuit board having a plurality of holes therein and at least one circuit thereon;

a conductive housing having sidewalls, at least one open end and being open at the bottom, said open end receiving said cable;

means for electrically connecting the shield of said cable to the inner surface of said housing adjacent the open end thereof;

a plurality of integral legs depending from said housing on either side of said open side, said legs being inserted into selected holes in said printed circuit board to connect said conductive housing to selected parts of the circuit printed thereon; and a pair of integral tabs formed on said housing between the legs of each pair of legs, said tabs projecting into said housing at an acute angle to said sidewalls and contacting said dielectric.

20. The connection of claim 19 wherein said center conductor extends beyond said dielectric and at substantially a right angle thereto, said tabs positioning said dielectric such that said extending center conductor passes through a further selected hole in said printed circuit board.

21. The connection of claim 19 wherein a heat shrinkable sleeve is shrunk over a portion of said cable and a portion of said housing adjacent the open end thereof.

22. The connection of claim 19 wherein said tabs are sufficiently flexible to permit them to accommodate dielectrics of differnt diameters.

23. The connection of claim 19 wherein a plurality of said coaxial cables are received by said housing, the shield of each such cable being connected to said housing and the dielectric of each such cable being positioned between said tabs.

24. The connection of claim 19 wherein said means for electrically connecting said shield to said housing is further defined as solder means.

* * * * *